US005203166A

United States Patent [19]

Miller

[11] Patent Number: 5,203,166

[45] Date of Patent: Apr. 20, 1993

[54] METHOD AND APPARATUS FOR TREATING DIESEL EXHAUST GAS TO REMOVE FINE PARTICULATE MATTER

[76] Inventor: John W. Miller, 580 Eyer drive, Unit 24, Pickering, Ont., Canada, L1W 3B7

[21] Appl. No.: 658,874

[22] Filed: Feb. 22, 1991

[51] Int. Cl.[5] ..... F01N 3/02

[52] U.S. Cl. ..... 60/274; 55/466; 55/DIG. 30; 60/297; 60/303

[58] Field of Search ..... 60/274, 286, 295, 303, 60/291, 297, 288; 55/466, DIG. 30

[56] References Cited

U.S. PATENT DOCUMENTS 4,813,231 3/1989 Bykowski ..... 60/286
4,899,540 2/1990 Wagner et al. .
4,923,484 5/1990 Saito .

FOREIGN PATENT DOCUMENTS 3529684 2/1987 Fed. Rep. of Germany ..... 60/303
57-110311 7/1982 Japan .
28505 2/1983 Japan ..... 60/303
183810 10/1983 Japan ..... 60/303

*Primary Examiner*—Douglas Hart

[57] ABSTRACT

An emission control system for reducing particulates from exhaust gases from a diesel engine includes dual catalyzed diesel particulate filters in joint communication with the exhaust stream and a pair of heater elements each associated with one of the filters, through which exhaust gas is transmitted and uniformly heated. According to predetermined alternating heating sequence, the exhaust gas stream through first one of the pair of filters and then through the other is heated. The differing pressure differentials across the filters, determined by the heating sequence, effectively shift the major portion of the flow of exhaust gas between the filters, so that over the alternating heating sequence the heat generated by the heating elements is sufficient to clean the filters, without the requirement for any auxiliary source of combustion air or any mechanical switching means.

5 Claims, 6 Drawing Sheets

METHOD AND APPARATUS FOR TREATING DIESEL EXHAUST GAS TO REMOVE FINE PARTICULATE MATTER

BACKGROUND OF THE INVENTION

1. Field of the Invention

The invention is directed general to a method and apparatus for controlling diesel emissions for small to medium-sized mechanical handling equipment and particularly to a diesel particulate filter system for use with diesel powered forklift trucks.

2. Prior Art

Diesel engines are used in a variety of applications including forklift trucks for versatility, economy, safety and their characteristic low levels of gaseous emissions such as CO, $CO_2$, $NO_x$, $SO_x$ and hydrocarbons. The release of such pollutants into a working environment, even at relatively low levels is nevertheless a health concern, as is the emission of particulate pollutants (soot), which typically are present at a level of 1 to 2 $g/m^3$ in diesel exhaust gas. Negative health effects of particulate emissions stem in part from the presence of potentially carcinogenic polyaromatic hydrocarbons.

Existing control technologies employed where diesel engines are operated in enclosed environments to reduce the emissions associated with diesel fuel combustion include ventilation, fume diluters, water scrubbers, catalytic purifiers and diesel particulate filters.

Catalytic purifiers act to substantially reduce the level of gaseous emissions and the liquid fraction of particulate emissions. Such devices incorporate a precious metal catalytic coating on pellet, ceramic, or metal substrates to convert CO and low molecular weight hydrocarbons to $CO_2$ and water.

Diesel particulate filters are designed to eliminate 90% or more of diesel particulate as measured by the U.S. Federal Test Procedure. A filter trap comprising cellular ceramic elements is installed downstream of the exhaust manifold. When the quantity of trapped particulates is such as to cause the engine exhaust pressure to rise above a certain level, the particulates are burned off to regenerate the filter.

U.S. Pat. No. 4,899,540 (Wagner et al.) discloses the use of one or more ceramic filters for particulates in the exhaust gases of a diesel engine. A heating element is mounted on the intake end of each ceramic filter and regeneration is effected by turning on the heating element to radiate heat towards that end of the filter, turning on an air source to blow a low flow of combustion air through the filter and detecting the condition of regeneration and readiness for use by means of an arrangement of sensors.

U.S. Pat. No. 4,923,484 (Saito) discloses the removal of fine exhaust particles by the use of dual ceramic filters, with a mechanical valve arrangement and heating elements for alternately burning the particles from each filter.

Known emission control systems, by reason of their use of mechanical switching arrangements of varying degrees of complexity to divert the exhaust flow between individual members of a bank of diesel particulate filters, or their use of an external source of combustion air, do not lend themselves to easy retrofitting onto forklift trucks or like diesel machinery.

OBJECTS AND SUMMARY OF THE INVENTION

It is an object of the present invention to provide an emissions control system which may readily be installed on an existing forklift truck or like diesel powered machinery and will reduce particulate emissions by more than 90% along with reduction of gaseous emissions.

It is a further object of the invention to provide a diesel engine exhaust particulate filter system with a valveless dual filter arrangement relying on heated exhaust gas current flows to regenerate the filter elements and requiring no auxiliary source of combustion air.

It is a still further object of the invention to provide a method for regenerating diesel particulate filters in a diesel engine emissions control system including a pair of such filters, which requires no mechanical diversion of the exhaust gas stream between filters and no introduction of auxiliary combustion air.

With a view to realizing these objects, the present invention provides, in one aspect thereof, a method for regenerating a first and second ceramic filter loaded with particulates from diesel exhaust, where the filters are in joint communication with the engine exhaust and each is provided at its intake end with a switchable heater, the two heaters being operable when turned on to uniformly heat exhaust gas passing through them to a temperature at which the particulate is burned off the filters. The method comprises the steps of:

(a) turning on the first heater, for a selected period of time, such that a portion of the particulates held by said first ceramic filter is burned off during passage of heated exhaust gases therethrough and the flow rate of exhaust gases through said first ceramic filter becomes substantially greater than the flow rate of exhaust gases through said second ceramic filter;

(b) turning off said first heater and turning on said second heater for a selected period of time, such that the initially lower flow of heated exhaust gas through said second filter regenerates it essentially completely and the flow rate of exhaust gases through said second filter becomes greater than through the partially regenerated first filter; and (c) turning off said second heater and turning on said first heater for a selected period of time, such that the initially lower flow of heated exhaust gas through the partially regenerated first filter regenerates it essentially completely.

In another aspect, the invention is an emissions control system for a diesel engine, which comprises:

(i) a pair of diesel particulate filters each having an intake end and an outlet end;

(ii) a pair of switchable electric heaters including means for connection to an external power source, each of said heaters being mounted to the intake end of one of said filters and operable when turned on to uniformly heat a stream of exhaust gas passing therethrough to a temperature sufficient to sustain combustion of particulate on the filter to which it is mounted;

(iii) an intake manifold connecting the upstream ends of said heater to the exhaust of said diesel engine, so that said filters are in joint communication at their intake ends with the exhaust gases generated by the engine; and (iv) electronic sequencing means operable to turn one of said heaters on for a predetermined period at the commencement of a regeneration cycle for a system and then to turn the heaters alternately on and off for predetermined periods of time until both said diesel particulate filters have been essentially completely purged of particulate by heated exhaust gas streams passing therethrough.

The foregoing and other objects and features of the invention will become apparent from the following description made with reference to the drawings.

DETAILED DESCRIPTION OF THE PREFERRED EMBODIMENT

Figure 1:
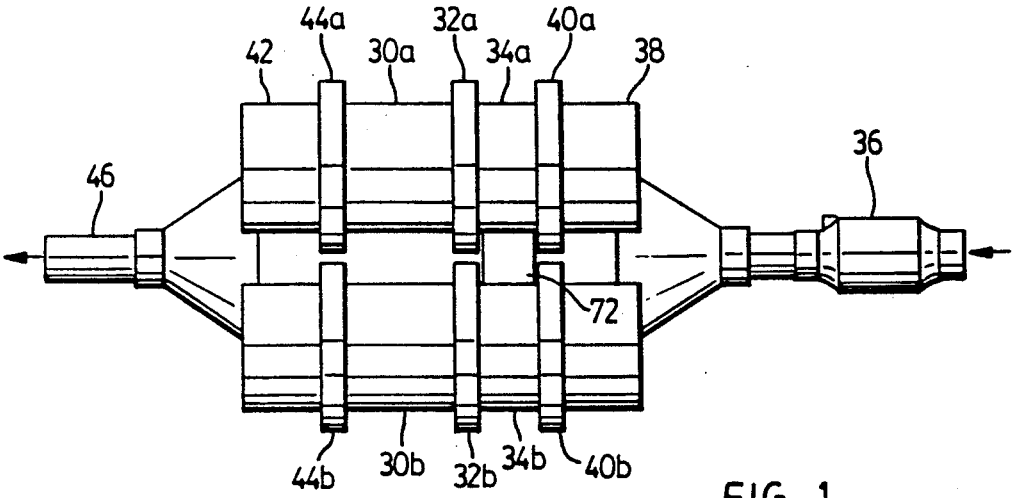
FIG. 1 is a schematic side elevational view of an embodiment of the emissions control system according to the invention.
Figure 2:
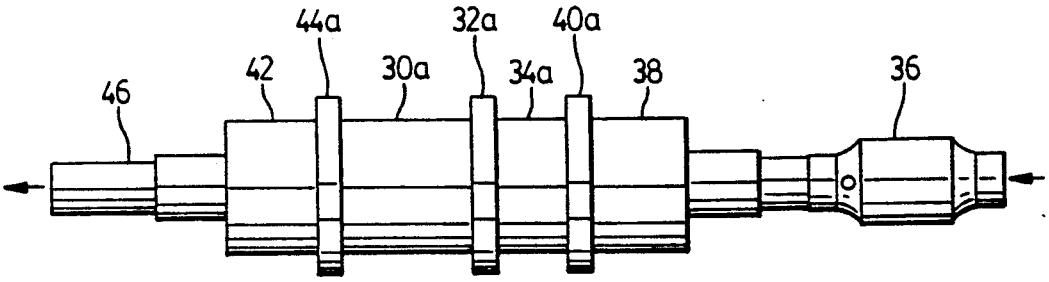
FIG. 2 is a sectional view of a portion of the apparatus of FIG. 1, seen along the direction line A—A.

Referring to the drawings, in which like reference numerals designate identical or corresponding parts throughout the several views, FIGS. 1 and 2 illustrate an emissions control system including dual catalyzed diesel particulate filters 30*a* and 30*b*. Mounted directly in front of each filter by quick release clamps 32*a* and 32*b* are associated ceramic heater elements 34*a* and 34*b* which are used according to the method of the invention to sequentially regenerate the filter monoliths. The structure and operational control of heater elements 34*a* and 34*b* are described below in connection with FIGS. 4 and 5.

The system of the invention is preferably used in conjunction with a close-coupled catalytic purifier 36 for gaseous emissions control. Raw exhaust from the diesel engine passes through catalytic purifier 36 in the direction of arrow I and the exhaust stream enters inlet manifold 38 and passes in separate streams through heater elements 34*a* and 34*b*, to which the inlet manifold is coupled by quick release clamps 40*a* and 40*b*. Thus the intakes of filters 30*a* and 30*b* are in joint communication with the stream of exhaust from the engine. After passage through particulate filters 30*a* and 30*b*, the exhaust streams are recombined in outlet manifold 42 connected to the downstream ends of the filters by quick release clamps 44*a* and 44*b*, and the treated exhaust stream is vented through tailpipe 46 in the direction of arrow O.

Catalytic purifier 36 is a conventional device such as Engine Control Systems Model No. ECS 4DM in which the precious metal active catalyst, mounted on a metal support, acts to lower CO and hydrocarbon levels by oxidizing these to harmless $CO_2$ and water, with minimal production of acid gases such as $NO_2$ and $SO_3$. As essentially a "no maintenance" technology, the catalytic purifier plays no role in the control and regeneration of the diesel particulate filter system of the invention. The catalytic purifier does, however, contribute to the reduction of the level of particulates in the exhaust stream.

As with any diesel emissions control technology including the control of particulates in the range of >90%, the diesel particulate filters 30*a* and 30*b* of the present system must be periodically regenerated, the frequency of regeneration depending upon soot production, collection efficiency and engine backpressure specification.

According to the present invention, the use of catalytic treated filter traps 30*a* and 30*b* to lower the ignition temperature of captured particulates in conjunction with associated inline heaters 34*a* and 34*b*, so designed as to provide even heating over the cross-section of a stream of exhaust gas, allows efficient and relatively quick regeneration of the filter traps by the heated exhaust gas, with no requirement for auxiliary combustion air as in prior art systems.

This method of "assisted regeneration" operates generally as follows: When the system of FIG. 1 is installed on the diesel engine, exhaust gas flow is split evenly between filters 30*a* and 30*b* as evidenced by equal particulate deposition. When regeneration is called for, which may be determined empirically or by measurement of the engine backpressure, the vehicle is taken to a well-ventilated regeneration station where, under the control of printed circuit board electronic controller means, one heater element, say 34*a*, is turned on for a selected period of time while the other, 34*b*, remains cold. Because of the dynamics of fluid flow, this has the result of forming a clean central "channel" through filter 30*a*.

When element 34*a* is turned off and 34*b* is turned on for the selected period of time, the majority of gas flow is directed through the "channel" of filter 30*a*, so that a relatively low rate of "plug" flow of heated exhaust gas passes through filter 30*b*, effectively regenerating it 100%. The heating elements are then switched back and the majority of exhaust gas now flows through filter 30*b*, allowing filter 30*a* to be cleaned by a slow plug flow through it of heated exhaust gas. To provide assurance of the complete removal of residual particulate from those filters, the heating elements may then be advantageously be switched back yet again, turning off heater 34*a* and turning on heater 34*b* for the selected period of time, to insure removal of any residual particulate from filter 30*b*. In short, the differing pressure differentials across the filters, determined by the heating sequence, effectively acts as a "valve", allowing the heaters to generate enough heat to clean the filters over an alternating heating sequence.

As noted above the particulate filters used in the system of the invention are catalytic treated traps, the catalyst serving to lower the ignition temperature of trapped particulates and imparting a measure of "self-regeneration" to these filter traps. Full regeneration of the traps is assisted, as heretofore described, by the passage of a low flow of heated exhaust gas therethrough.

Figure 3:
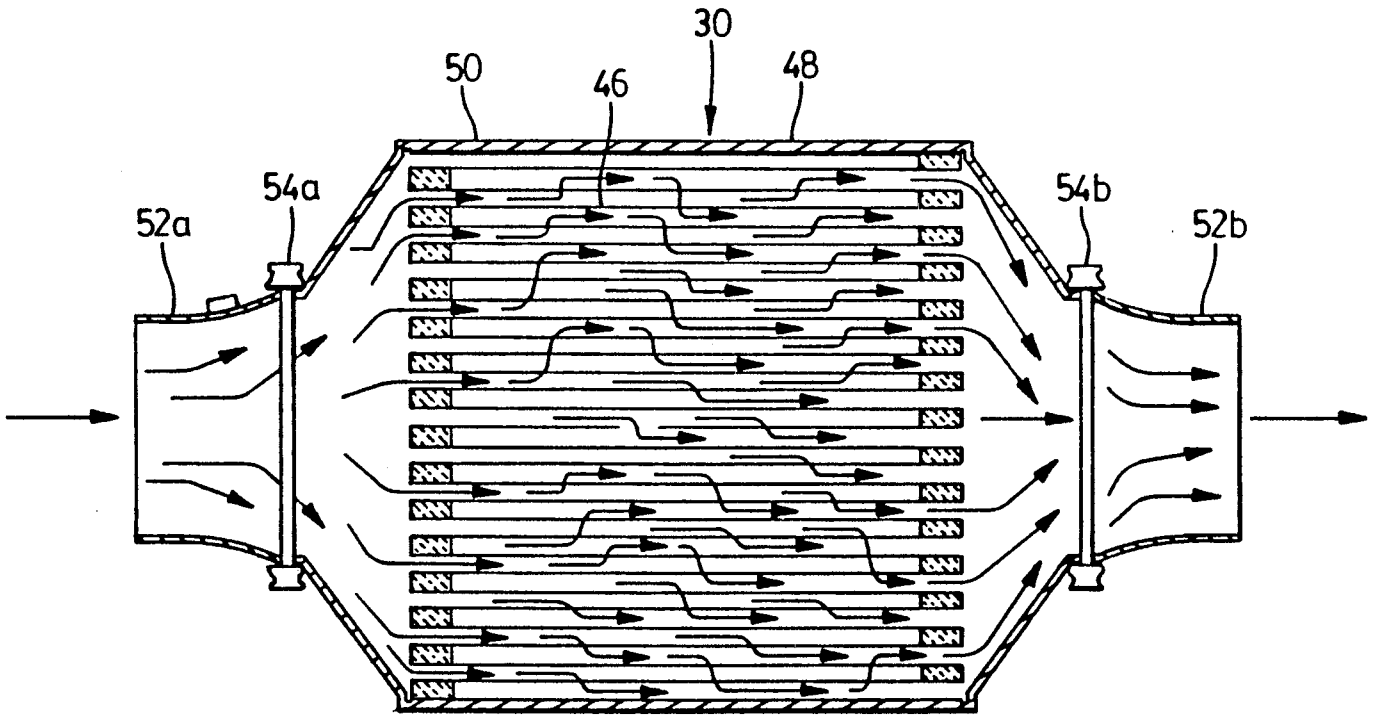
FIG. 3 is a schematic sectional view of a ceramic catalyzed diesel particulate filter of a kind which may be used in the system of FIG. 1.

As catalyzed filters 30*a* and 30*b* there may advantageously be used diesel particulate filters sold under the name ECS Purifilter (trademark). The operating principle of this component is illustrated in FIG. 3, in which the filter trap is indicated generally at 30. The filter block 46 is itself made of EX-66-100 CPI (catalyzed cordeirite) and presents a plurality of interior passages for movement therethrough of the gas stream in the direction of the arrows. The filter block is wrapped in insulation packing 48 made of Interam (trademark), a fibrous insulation which expands slightly on heating, and an outer shell 50 of 321 stainless steel which is connected to inlet and outlet ducts 52*a* and 52*b* by quick release clamps 54*a* and 54*b*, respectively.

Filters of this kind are effective in reducing carbon smoke emissions by about 90%. If the exhaust gas is introduced at a temperature in the range of about 380–500° C., about 100° C. lower than the effective range for most uncatalyzed diesel filters, the catalyzed filters have "self regenerating" capabilities. However, the temperature of the exhaust gas from small diesel powered equipment such as a forklift truck is relatively low, about 250° C. For that reason preliminary auxiliary heating by inline heaters (34*a* and 34*b* in FIG. 1) is necessary.

For effective regeneration of filters 30*a* and 30*b* by alternation of the heating of exhaust streams in the method of assisted regeneration according to the invention, it is essential that the heating elements 34*a* and 34*b* be so constructed that heat is evenly distributed across the cross-section of the exhaust gas stream. A novel arrangement of components in a heating element 34 which has been found to achieve this even heating is illustrated in FIGS. 4 and 5.

Figure 4:
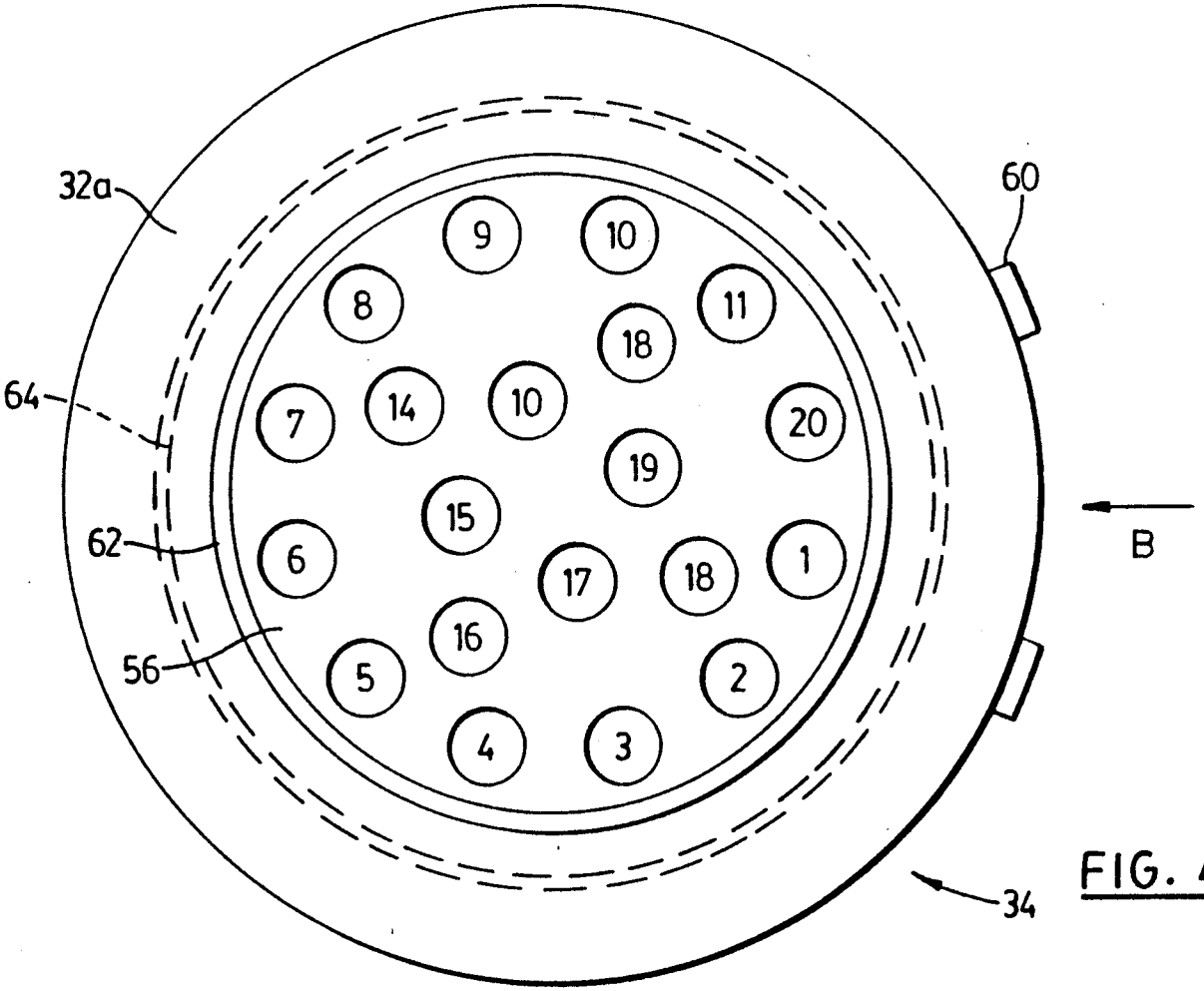
FIG. 4 is an end plan view of a heater element useful in the system of the invention.
Figure 5:
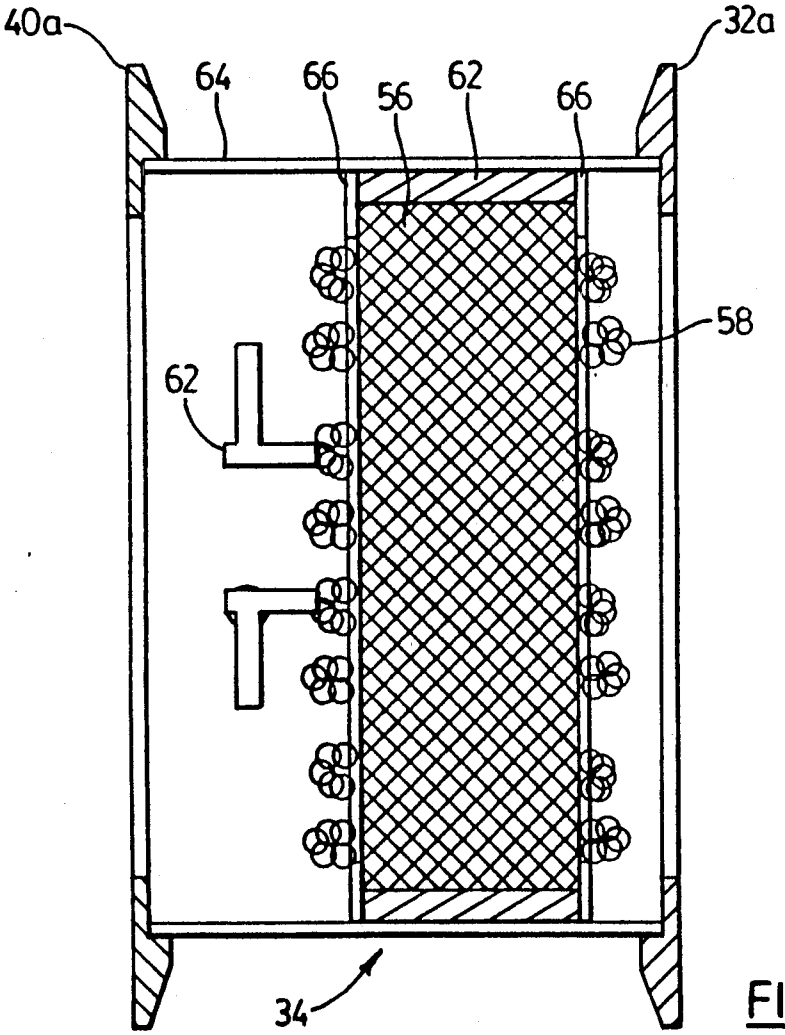
FIG. 5 is a side elevational view of the heater element of FIG. 4, seen along the direction B.

Heating element 34 comprises a commercially available (Corning EX-47-100 CPI) "honeycomb" ceramic monolith, 56, which has been drilled through longitudinally with a concentric circular array of offset holes, numbered 1 to 20 in FIG. 4. A length of Ni-Cr wire winding, 58, shown only in FIG. 5, is threaded through the holes alternately, i.e. into the plane of FIG. 4 through hole 1, out through hole 2, in through hole 3, etc. The free ends of wire winding exit the heating element through porcelain insulators 60 and join stainless steel wire connectors 62, for electrical connection to a power source as described below. The resistance of such a heating element is around 9–10 Ω. When connected to a 220V AC source, it generates enough power to regenerate the associated diesel particulate filter, with the ceramic monolith of the heating element acting as a heat sync and as a heat distributor. The use of "bare" heating elements of the kind used in electric stoves was found to be unsatisfactory, presumably because the localized heating which they provide do not effectively transfer heat throughout the exhaust stream.

Ceramic monolith 56 is protected by a surrounding Interam insulating layer 62, the whole being held in position within stainless steel shell 64 by retaining rings 66.

EXPERIMENTAL RESULTS

A diesel emissions control system according to the invention, developed for a Toyota 2.5 1 forklift truck, was constructed substantially as illustrated in FIGS. 1 and 2 and as described above. The installation of the system in the forklift truck 68 is schematically illustrated in FIG. 6.

Figure 6:
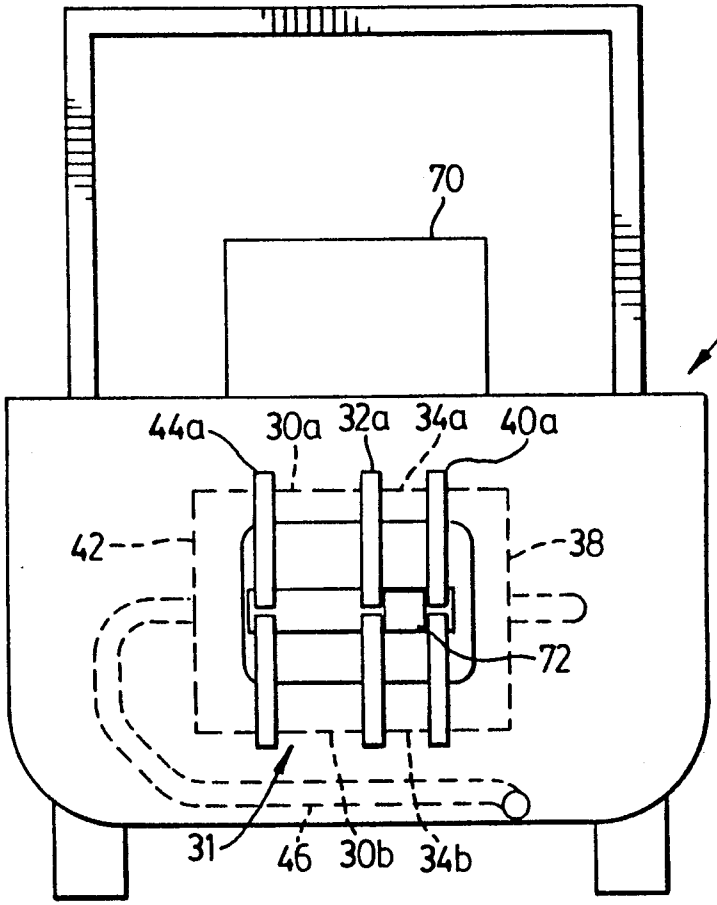
FIG. 6 is a schematic illustration of an emissions control system according to the invention, installed in a forklift truck.

As seen in FIG. 6, an emissions control system 31 according to the invention fits conveniently under the counterweight 70 of the truck like a replacement muffler. The system includes a close-coupled catalytic purifier like component 36 in FIG. 1 (not shown in FIG. 6) mounted close to the engine manifold for maximum gaseous emission control; two 4.66"×6" catalyzed diesel particulate filters (ECS Purifilter) mounted in parallel to ensure good particulate filtration efficiency; two 3.0 kW heater elements 34*a* and 34*b* constructed as described above in connection with FIGS. 4 and 5; a backpressure alarm (not shown); an electronic regeneration controller (not shown); and a 220V electrical connector (not shown) to the Ni-Cr heating wires of heating elements 34*a* and 34*b* for use with shore power. In FIGS. 6 and 1, reference numeral 72 indicates a perforated metal stand-off which precludes accidental touching of the electrical connections when the system is exposed.

The system of FIG. 6 was designed to operate for a full eight-hour shift before requiring regeneration, while staying within the engine manufacturer's backpressure specification of 26 KPa. However, as a fail-safe measure, an electronic backpressure alarm was included to ensure alerting of the forklift operator, should the amount of soot provided by the engine increase to a point where the critical backpressure is exceeded in less than eight hours or should an eight-hour regeneration sequence fail to be performed, through operator inadvertence.

After eight hours of operation, the vehicle is brought to a well-ventilated regeneration station where the operator plugs 220V shore power into an on-board 220V adaptor (not shown) and flips a switch to initiate the regeneration process for both particulate filters under the control of a printed circuit board electronic controller (not shown).

Figure 7:
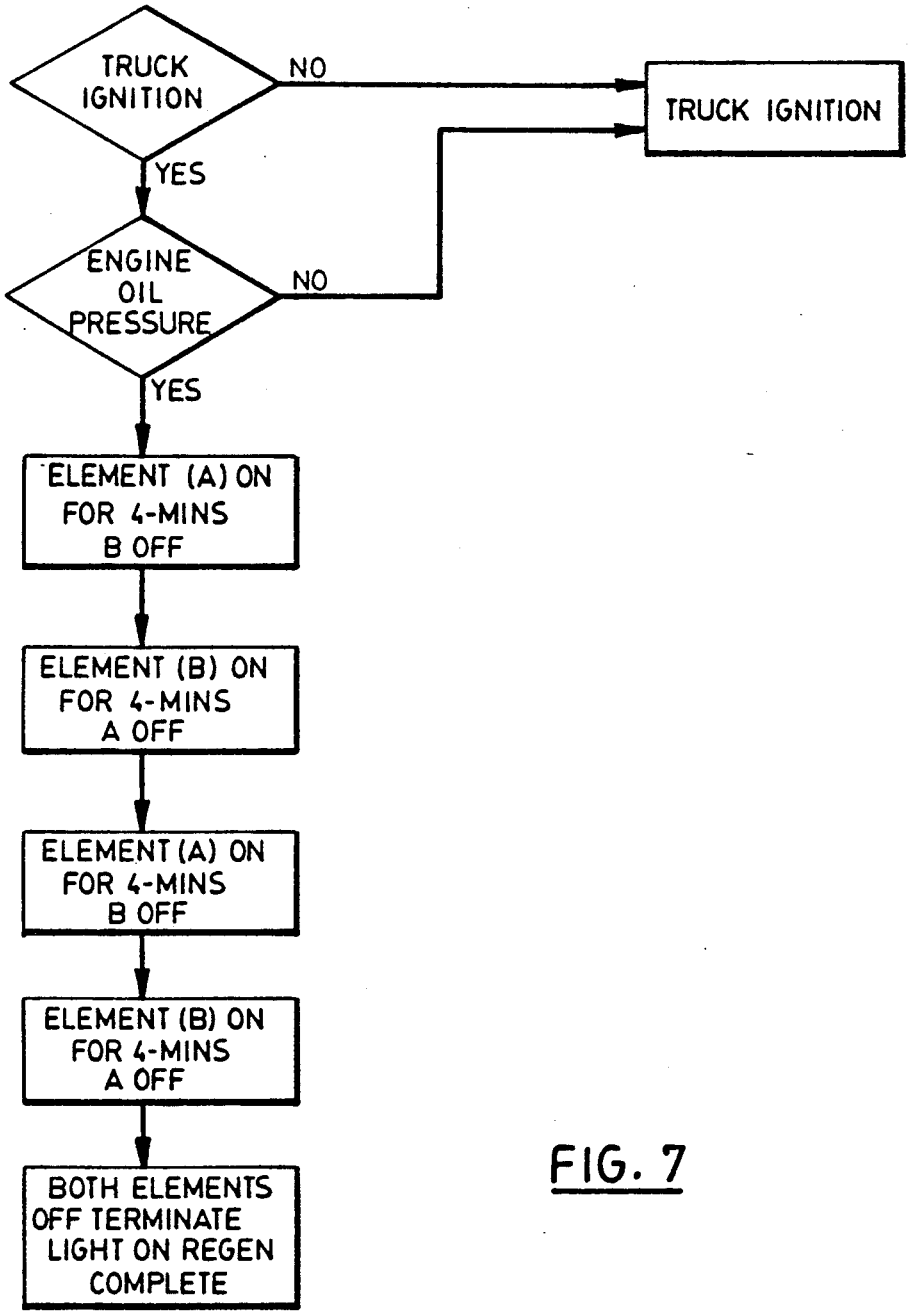
FIG. 7 shows a logic diagram for the electronic heater control system used in an embodiment of the system of the invention.

The logic diagram for control of the heater elements of the system of FIG. 6 is shown in FIG. 7, where "A" refers to heater element 34*a* and "B" to heater element 34*b*. The controller first switches power on to element A alone. This partially regenerates the first filter. As a result of this partial cleaning, the majority of exhaust gas flow is directed through this filter. When power is switched to the second heater element (element B) for four minutes, the second filter is virtually 100% regenerated and the greater part of the exhaust gas then flows through this filter. This allows the first filter to be completely cleaned when the power is again switched back to heater element A for four minutes.

Figure 8:
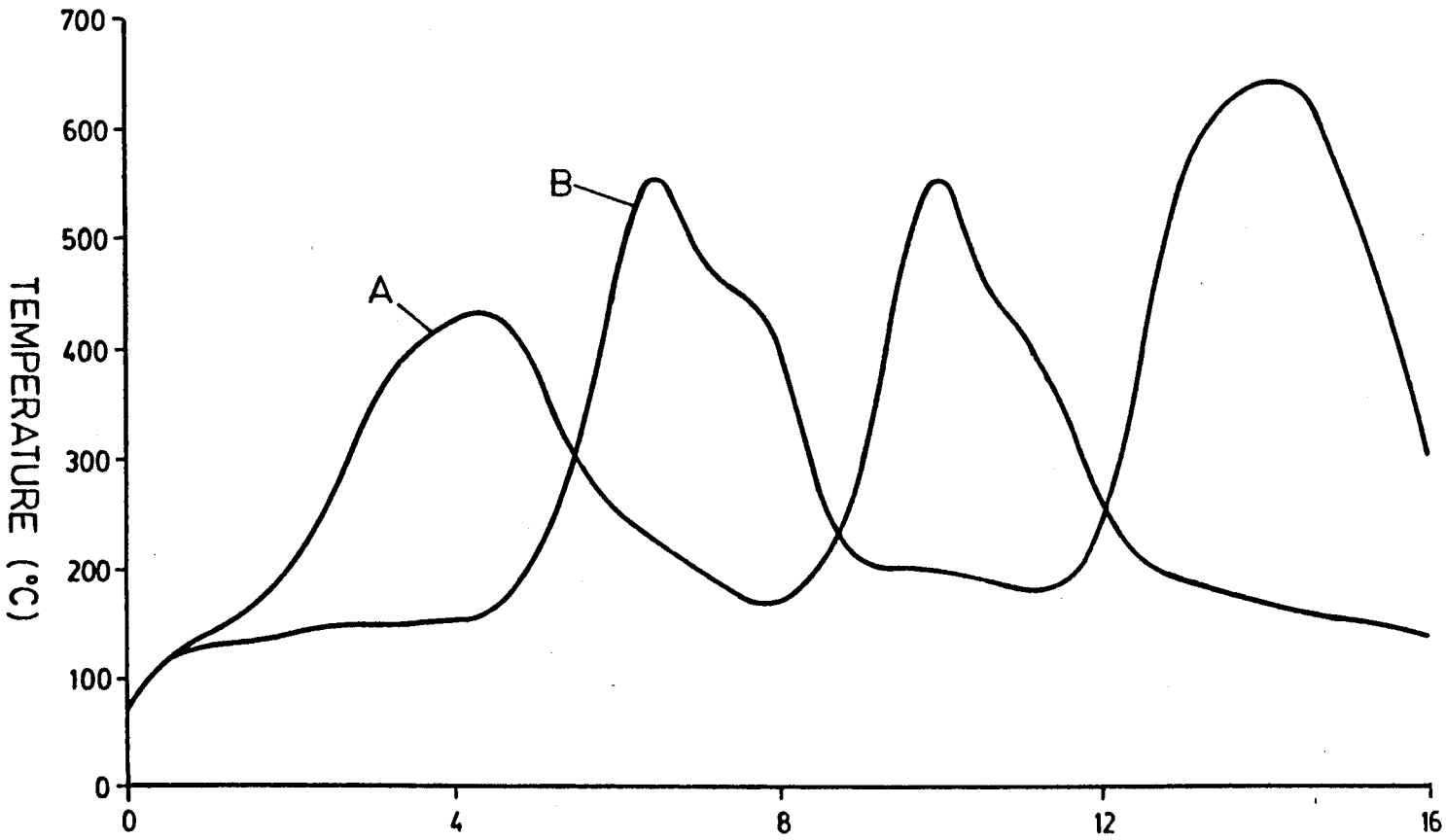
FIG. 8 is a graph of the filter exhaust gas temperatures with time over the course of a regeneration sequence according to the method of the invention.

To ensure removal of residual particulate, heater element B is powered for a further (fourth) four minute period. The exhaust gas temperatures from filters A (30*a*) and B (30*b*) over the course of the 16 minute regeneration process are shown in the graph of FIG. 8.

The following table sets out representative backpressure measurements taken before and after regenerations for the system of FIG. 6 installed on a Toyota 2.5 1 forklift.

| | BACKPRESSURE (KPa) | | | | | |
|---|---|---|---|---|---|---|
| | DAY 1 | DAY 2 | DAY 3 | DAY 4 | DAY 5 | DAY 6 |
| BEFORE | 27 | 24.7 | 23.7 | 21.6 | 23.0 | 23.0 |
| AFTER | 13.5 | 16.9 | 14.2 | 15.6 | 13.5 | 14.9 |

Although the engine manufacturer's specification of 26 KPa was essentially respected, introduction of the emissions control system led to higher backpressure than with only the ECS 4 DM catalytic purifier in place for emissions control. This may have led to observed fuel consumption levels of between 2% and 8% higher in the truck outfitted with the emissions control system at FIG. 6 compared with two trucks not so equipped, measured over a three month period, but the limited sample might not have been statistically significant.

Oil analyses of the test truck taken for several months showed no change over data accumulated on many control trucks over many years, from which it may be concluded that installation of the system produced no detrimental engine wear effects.

From more than 3000 hours of field testing it was concluded that: (1) The on-board electrical regeneration system provides sufficient heat and heat distribution to effectively clean the diesel particulate filters. (2) The system used in conjunction with an ECS 4DM catalytic purifier affords about 90% reduction in particulates, with no adverse additional engine wear. (3) A slight fuel penalty may be incurred through use in a forklift truck of the diesel particulate filter system of the invention.

Although a particular embodiment of the method and apparatus of the invention has been described in detail, it will be appreciated by those skilled in the art that other equivalents may be possible as well and understood that it is not intended to impose a limitation to the specific construction and operation steps shown and described herein. The invention sought to be protected is defined by the appended claims.

I claim:

1. A method for regenerating a first ceramic filter and a second ceramic filer both loaded with particulates from exhaust gases of a diesel engine, said filters being in joint communication with the exhaust from a diesel engine and each being provided at the intake end thereof with first and second switchable heaters, respectively, operable when turned on to uniformly heat a stream of exhaust gas passing therethrough to a temperature sufficient to sustain combustion of particulate on said filters, comprising the steps of:

(a) turning on said first heater for a selected period of time, such that a portion of the particulates held by said first ceramic filter is burned off during passage of heated exhaust gases therethrough and the flow rate of exhaust gases through said fist ceramic filter becomes substantially greater than the flow rate of exhaust gases through said second ceramic filter;

(b) turning off said first heater and turning on said second heater for a selected period of time, such that the initially lower flow of heated exhaust gas through said second filer regenerates it essentially completely and the flow rate of exhaust gases through said second filter becomes greater than through the partially regenerated first filter;

(c) turning off said second heater and turning on said first heater for a selected period of time, such that the initially lower flow of heated exhaust gas through the partially regenerated first filter regenerates it essentially completely; and (d) turning off said first heater and turning on said second heater for a selected period of time to ensure complete regeneration of said second filter, wherein the exhaust from the diesel engine is passed through a catalytic purifier before passing through said first and second heaters.

2. An emissions control system for a diesel engine, comprising:

(i) a pair of ceramic catalyzed diesel particulate filters each having an intake end and an outlet end;

(ii) a pair of switchable electric heaters, each comprising a ceramic honeycomb monolith having a length of resistive wire winding threaded through a regular pattern of holes drilled through said monolith and means for connecting said wire winding to an external power source, each of said heaters being mounted to the intake end of one of said filters and operable when turned on to uniformly heat a stream of exhaust gas passing therethrough to a temperature sufficient to sustain combustion of particulate on the filter to which it is mounted;

(iii) an intake manifold connecting the upstream ends of said heater to the exhaust of said diesel engine, so that said filters are in joint communication at their intake ends with the exhaust gases generated by the engine; and (iv) electronic sequencing means operable to turn one of said heaters on for a predetermined period at the commencement of a regeneration cycle for a system and then to turn the heaters alternately on and off for predetermined periods of time until both said diesel particulate filters have been essentially completely purged of particulate by heated exhaust gas stream passing therethrough.

3. An emissions control system according to claim 2, wherein the number and configuration of said holes is such that heat is uniformly distributed across said monolith when said power source is connected and said heater is turned on.

4. An emissions control system according to claim 3, wherein the length and resistance of said wire winding is such as to develop about 0.3 kW of heating power.

5. An emissions control system according to claim 2, further comprising electronic backpressure alarm means for detecting an unduly high engine backpressure arising from particulate loading of said filters.

* * * * *